United States Patent [19]

Sinar

[11] Patent Number: 4,573,620

[45] Date of Patent: Mar. 4, 1986

[54] APPARATUS FOR ABSORBING A FORCE APPLIED TO A CABLE OR THE LIKE

[75] Inventor: Michael M. Sinar, Valparaiso, Ind.

[73] Assignee: United States Steel Corporation, Pittsburgh, Pa.

[21] Appl. No.: 657,654

[22] Filed: Oct. 4, 1984

[51] Int. Cl.[4] ..... B65H 20/00

[52] U.S. Cl. ..... 226/190; 226/113; 248/562

[58] Field of Search ..... 226/104, 109, 113, 118, 226/119; 254/266, 274, 278, 414; 242/55.01; 267/8 R; 248/564, 565, 562

[56] References Cited

U.S. PATENT DOCUMENTS

| | | | |
|---|---|---|---|
| 1,998,206 | 4/1935 | Rosenzweig | 248/16 |
| 3,061,272 | 10/1962 | Elenburg | 254/414 |
| 3,130,888 | 4/1964 | Rothfuss et al. | 226/113 |

*Primary Examiner*—Leonard D. Christian
*Attorney, Agent, or Firm*—William F. Riesmeyer

[57] ABSTRACT

Apparatus for controlling the jerk or shock loading of the wire rope used to apply tension to move a galvanizing or pickle line's horizontal looper car. The apparatus includes a vertical spindle affixed to the frame of the looper car. A drum having a radially extending arm is provided to be rotatable about the spindle. The arm is provided with an intermediate region to anchor the wire rope and a terminal region to cooperate with a resilient shock absorbing means which may comprise a polyurethane pad. Such shock absorbing means includes a bracket affixed to the looper car frame. A spring-biased bolt connects the arm to the bracket while a resilient pad is provided intermediate the arm and the bracket.

6 Claims, 4 Drawing Figures

APPARATUS FOR ABSORBING A FORCE APPLIED TO A CABLE OR THE LIKE

DESCRIPTION OF THE INVENTION BACKGROUND

The present invention relates to an apparatus for absorbing a sudden shock loading or jerk applied to a cable and, in particular, to an apparatus for absorbing the jerk applied to a cable used to operate a looping car which is employed to provide a temporary storage of a web of material during the processing thereof.

In the processing of a continuous web of material, such as steel, it is occasionally necessary to temporarily store a portion of the web in order that distinct lengths of the web may be joined so that the process steps may occur continuously. For example, in the steel industry, it is expedient that certain processes such as cleaning (or pickling) or the electrogalvanizing process, run on a continuous sheet of material. As such, it is necessary that a storage area be provided to accommodate excess sheet material which may be processed while the entry end is stopped for welding individual strips together or while the exit end is stopped for separating and individually bundling the sheet products.

In a commonly employed system, a series of multiple tiers of horizontal tracks are provided. A wheeled vehicle, or looper car, is configured to ride on the uppermost and lowermost of each such tracks. Each of the looper cars carries a horizontal roll whose axis is perpendicular to the direction of travel of the strip. Stationary rolls are provided in intermediate levels to provide additional storage. The strip is successively wrapped around the looper cars and the stationary rolls in order that when the looper cars are at the ends of their tracks a maximum amount of sheet may be stored. When the mill is prepared to accommodate the stored strip, the looper cars are drawn toward the stationary rolls on the opposite ends of their respective tracks by the action of the strip on the looper cars and a minimum amount of strip is maintained in the storage region.

To store additional strip material in the storage area, the looper cars are each moved toward the ends of their respective tracks and against the action of the strip by means of cables which are provided from a motorized winch means. In the past, to affix the cables to the looper cars, the cables were wound about a vertical pipe affixed to each looper car and bolted to a support affixed to such pipes. The action of the respective winches on the cables causes the looper cars to move to the ends of the tracks against the force of the strip thereby drawing an increased length of strip into the storage area.

It will be readily appreciated that the cycle of filling and emptying the storage area by means of the releasing and the regathering of the cables which move the looper cars must occur frequently and rapidly as the strip under process is continuously moving at a high linear speed. As such, the cables affixed to the looper cars are frequently being pulled suddenly and rapidly by the winch. Such rapid pulling or jerking of the cables has been definitively proven to cause the premature failure of such cables. Of course, when such cables fail, the entire processing line must be stopped to allow replacement of the broken cable. It is apparent that the total cost of halting production of an entire line to replace a cable is staggering. Also, the cost of replacement cable and the manpower to replace it is considerable. Accordingly, a means of preventing premature cable failure due to the jerk loading of such cables is most necessary.

As such, the present invention is directed toward an apparatus for absorbing the jerk loading applied to a cable which overcomes, among others, the above-discussed problems and provides an effective, low-cost apparatus for absorbing shock in a cable to prolong its life.

SUMMARY OF THE INVENTION

In accordance with the present invention, there is provided apparatus for absorbing the sudden shock or jerk loading applied to the dead end of a cable. The jerk absorber may be mounted on a vehicle which is movable by a cable that is controlled by a motorized winch. The jerk absorber may be mounted on the end of such vehicle closest to such winch and includes a spindle affixed to the vehicle's frame and a cable-receiving drum which is disposed over the spindle so as to be rotatable about the axis of the spindle. An arm is provided to extend radially from the drum and perpendicular to its axis. Such arm includes a face area perpendicular to the direction of travel of the arm when the drum is rotated by the cable. A bracket means is provided opposite such face area and a resilient member is interposed between the bracket and the face area of the arm by means of a spring-biased bolt.

In operation, the jerking force applied to the cable is transmitted to the drum which, in turn, rotates the arm, the movement of which is inhibited by the resilient member which temporarily deforms as it acts on the bracket and then returns to its original shape after absorbing the jerking force.

As such, the present invention provides solutions to the aforementioned problems in cable failure. Since this invention provides an effective means of absorbing jerk loads applied to a cable, the failure problems due to such loadings are alleviated. In addition, as the instant invention provides an effective, cost-efficient means for avoiding cable failure, the excessive costs of system downtime and replacement cable are eliminated.

These and other details, objectives, and advantages of the invention will become apparent as the following description of the present preferred embodiment thereof proceeds.

BRIEF DESCRIPTION OF THE DRAWINGS

In the accompanying drawings, I have shown a preferred embodiment of the invention wherein.

DETAILED DESCRIPTION OF THE INVENTION

Figure 1:
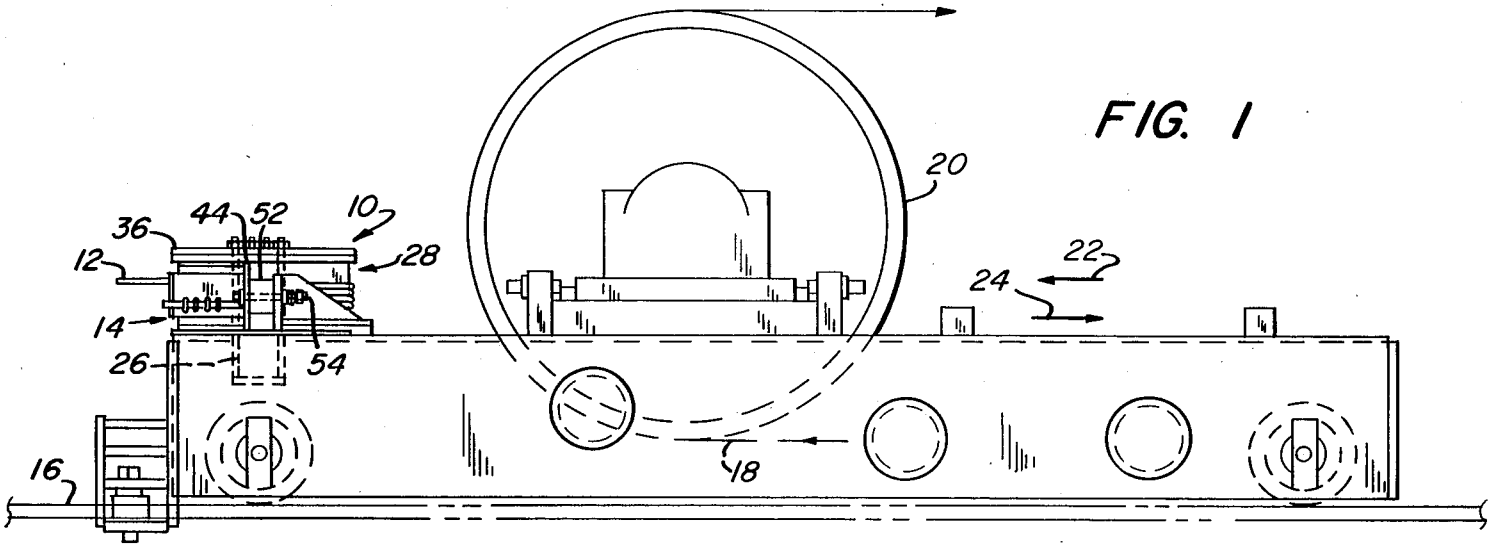
FIG. 1 is a side elevational view of the herein provided invention as installed on a looper car.
Figure 3:
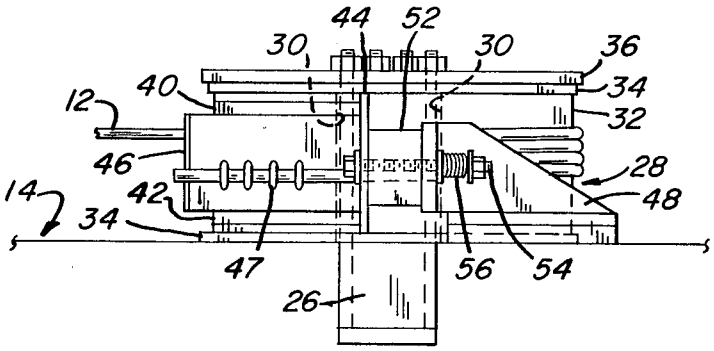
FIG. 3 is a side elevational view of the cable jerk absorber provided.

Referring now to the drawings wherein the showings are for purposes of illustrating the present preferred embodiment of the invention only and not for purposes of limiting same, the figures show an apparatus generally indicated as 10 for absorbing the force of a sudden pulling (or, as used herein, a shock or jerk loading) of a cable 12. The term "cable" as used herein is intended to include, but not be limited to, any rope, wire rope, line, cord, string, etc.

More particularly and with reference to FIG. 1, there is shown a looper car 14 which travels on horizontal rails 16. Looper car 14 supports a web or strip 18 by means of a roll 20, the axis of which is perpendicular to the direction of the strip 18 length. As is shown in FIG. 1, strip 18 passes around less than the entire circumference of roll 20 and, in fact, is wrapped around the roll 20 such that the web 18 only engages approximately one-half of the roll's 20 circumference. Accordingly, when the looper car 14 moves in one direction, indicated by arrow 22, a greater length of the strip 18 is disposed in a multi-tiered storage area parallel to rails 16 and when looper car 14 is moved in the opposite direction, indicated by arrow 24, less of the strip 18 is stored. As such, it will be appreciated that the movement of looper car 14 in such opposite direction 24 is caused by the withdrawing of the strip 18 from the storage area. That is, as the strip is withdrawn in a direction indicated by arrow 24, the looper car 14 is normally caused to move in such direction.

In order to cause looper car 14 to move in the direction indicated by arrow 22 so that a greater amount of strip 18 is stored parallel to rails 16, the dead end of cable 12 is affixed to looper car 14 by means of jerk absorber 10. The length of cable 12 which is extended parallel to and above track 16 is controlled by means of a winch (not shown) which, in turn, controls the displacement of looper car 14. Thus, when it is desired to allow the strip to move looper car 14 in directon 24 to release additional strip to be processed, the tension in strip 18 is increased beyond the withholding force applied to the winch. Conversely, when it is desired to move looper car 14 in direction 22 to store additional sheet 18, the cable is rewound by the winch overcoming the tension caused by the web 18 thereby storing additional web 18 parallel to tracks 16, hence looper car 14 is moved in the direction indicated by arrow 22.

As was explained above, the reversals in direction of travel of looper car 14 occur rapidly and violently thereby placing a great tensile load on cable 12. The alleviate the harmful effects of such loading and in order to prolong the useful life of cable 12, jerk absorbing apparatus 10 is provided to withhold the end of cable 12 and affix cable 12 to looper car 14. As such, apparatus 10 includes spindle 26 which consists of a vertically extending cylindrical pipe affixed to the frame of looper car 14 on the end thereof nearest the winch. A horizontal drum 28 is provided to be disposed over spindle 26 such that the inner cylindrical bearing surface 30 of drum 28 is in relatively close spaced clearance relation to spindle 26 so that spindle 26 and drum 28 are coaxial and drum 28 may rotate about spindle 26. The drum 28 includes an outer cylindrical surface 32 coaxial with and of a greater diameter than that of inner cylindrical bearing surface 30. Outer cylindrical surface 32 is configured so as to allow the cable 12 to be wrapped therearound and is preferably of such a diameter that the cable 12 will not be overly stressed by the wrapping thereof too tightly. In addition, the surface 32 is designed to prevent slippage of cable 12 while wrapped therearound.

Cylinders 30 and 32 are joined by means of end supports 34 which consist of round plates affixed to both the top ends and the bottom ends of cylinders 30 and 32. Bars 35 may be provided to extend at two locations between end supports 34 to assure that cable 12 remains properly wound about surface 32. An end cap 36 consisting of a round plate of larger diameter than end supports 34 is provided to be affixed to the uppermost end of spindle 26 to withhold drum 28 thereon during rotation.

In order that the jerk force applied to cable 12 may be diverted from cable 12 by means of jerk absorbing apparatus 10, arm 38 is provided to be affixed to cylindrical member 32 of drum 28. Arm 38 extends radially horizontally from drum 28 and consists of upper and lower horizontal members, 40 and 42, respectively, and vertical member 44 intermediate thereto. Vertical arm member 44 is provided with a face area 45 near the end thereof, such face area 45 having a horizontal aperture therethrough. Arm 38 is provided with a notched retention plate 46 which is affixed thereto intermediate members 40 and 42 and is disposed in a tangential relation to outer cylindrical surface 32 so that any additional stress on cable 12 is avoided. Retention plate 46 includes fixtures such as "U"-bolts 47 by which the end of cable 12 may be passed through the notch in and be affixed to retention plate 46, and, hence, the cable 12 will be firmly attached to the drum 28 by means of arm 38.

In addition, a bracket member 48 having a vertical surface 50 having a horizontal aperture therethrough is provided to be affixed to the frame of loop car 14 such that surface 50 is in facing relation to face area 45 of vertical arm member 44. A resilient member 52 is provided to be inserted intermediate vertical arm member 44 and bracket 48 and retained therebetween by means of bolt 54 passed through their respective apertures which bolt 54 is biased by means of spring 56, in part, to prevent chattering of arm 38. It must be appreciated that resilient member 52 may comprise a pad of polyurethane or rubber or any other material which resists deformation but when a force is applied thereto, becomes deformed and then resumes its original shape upon release of the force. Alternatively, resilient member 52 may comprise a compression spring. Preferably, resilient member 52 is preloaded by spring 56 in order that excessive deformation of member 52 may be avoided.

Figure 2:
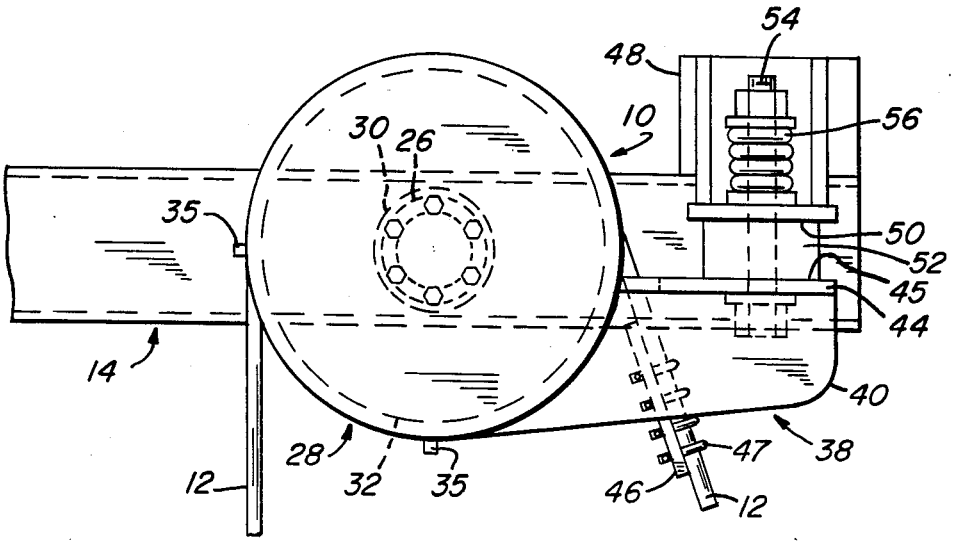
FIG. 2 is a plan view of the cable jerk absorber herein provided.
Figure 4:
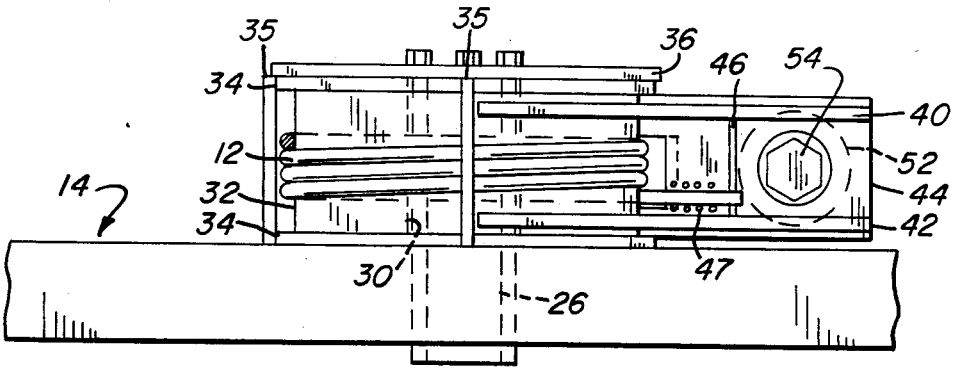
FIG. 4 is a front elevational view of the cable jerk absorber provided herein.

In operation of the herein provided apparatus, when it is desired to move the looper car 14, in direction 22, the cable 12 is rewound by the winch. As was explained above, the initiation of pulling by the winch is usually abrupt and creates a sudden, excessive jerk loading of cable 12 which loading is to be absorbed by means of jerk absorber 10. As such, when cable 12 is pulled abruptly in direction 22, the outer drum surface 32 around which cable 12 is wrapped is moved correspondingly which, in turn, rotates the entire rigid drum 28 assembly about spindle 26 in a counterclockwise direction as viewed in FIG. 2. Such counterclockwise movement of drum 28 causes arm 38 to move in direction 24, the face of vertical member 44 of arm 38 being forced against resilient member 52. As any movement of resilient member 52 is inhibited by means of bracket 48, resilient member 52 must absorb the force applied by vertical member 44. Upon the cessation of the application of force on cable 12, the resilient member 52 resumes its original shape and arm 38 and, hence, drum 28 are returned to their normal positions. Spring 56 prevents the overreturn of arm 38 and drum 28 as well as limiting chatter during normal operation.

By means of example only, for absorbing loads in excess of ten (10) tons in cable 12 having a diameter of three-fourths (¾) inch, outer cylindrical surface 32 may be twenty-four (24) inches and arm 38 may be twenty-three (23) inches as measured from the center of spindle 26 to the center of bolt 54. In such a case, it is preferable that a resilient member 52 which is eight (8) inches in diameter and five (5) inches thick and having a Durometer reading of seventy (70) be employed.

It must be appreciated that in other applications, rather than having a fixed winch and a cable affixed to a movable vehicle 14, the winch may be on a movable vehicle 14 and the cable 12 may be affixed to a fixed, non-movable support. In such case, jerk absorbing apparatus 10 may be provided on such fixed surface to absorb the jerking force applied to the cable 12 when it is desired to move the vehicle relative to the fixed end of the cable.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. Apparatus for absorbing a jerking load applied to a cable used to displace an object in one direction comprising:

a. a spindle affixed at one end thereof to said object;

b. a drum around which said cable may be wrapped, said drum being disposed around said spindle so as to be coaxial with said spindle and rotatable about the axis of said spindle;

c. an arm affixed at a first end thereof to said drum, said arm extending radially from said drum and perpendicular to the axis of said drum, said arm having a face area on the other end of said arm perpendicular to the direction of movement of said arm when said drum is rotated about said spindle, said face area being disposed on the leading side of said arm when said arm is moved by the action of said load on said cable and said cable on said drum respectively, said arm also having a means for retaining said cable;

d. a bracket means affixed to said object and having a surface disposed parallel to and opposite to said face area;

e. a first resilient member disposed between said face area and said surface, said resilient member being affixed to either said face area or said surface or to both said face area and to said surface;

f. a second resilient member coaxial with said first resilient member, said second resilient member being affixed to the opposite side of said surface from said first resilient member;

g. means for operatively connecting said first resilient member and said second resilient member; and h. a cover plate affixed to the end of said drum furthest from said object and configured so as to retain said drum on said spindle.

2. Apparatus of claim 1 in which said drum comprises:

a. an inner cylinder having a bearing surface in closely spaced clearance relation to said spindle;

b. an outer cylinder coaxial and coextensive with and of greater diameter than said inner cylinder, said outer cylinder being configured so as to allow said cable to be wrapped therearound; and, c. plate means to join the ends of said inner and outer cylinders.

3. Apparatus for absorbing a jerking load applied to a cable, the end of which cable is to be held relatively stationary, comprising:

a. a spindle affixed at one end thereof to a stationary object;

b. a drum around which said cable may be wrapped, said drum being disposed around said spindle so as to be coaxial with said spindle and rotatable about the axis of said spindle;

c. an arm affixed at a first end thereof to said drum, said arm extending radially from said drum and perpendicular to the axis of said drum, said arm having a face area on the other end of said arm perpendicular to the direction of movement of said arm when said drum is rotated about said spindle, said face area being disposed on the leading side of said arm when said arm is moved by the action of said load on said cable and said cable on said drum respectively, said arm also having a means for retaining said cable;

d. a bracket means affixed to said stationary object and having a surface disposed parallel to and opposite to said face area; and, e. a first resilient member disposed between said face area and said surface, said resilient member being affixed to either said face-area or said surface or to both said face area and to said surface;

f. a second resilient member coaxial with said first resilient member, said second resilient member being affixed to the opposite side of said surface from said first resilient member;

g. means for operatively connecting said first resilient member and said second resilient member; and h. a cover plate affixed to the end of said drum furthest from said object and configured so as to retain said drum on said spindle.

4. Apparatus of claim 3 in which said drum comprises:

a. an inner cylinder having a bearing surface in closely spaced clearance relation to said spindle;

b. an outer cylinder coaxial and coextensive with and of greater diameter of said inner cylinder, said outer cylinder being configured so as to allow said cable to be wrapped therearound;

c. plate means to join the ends of said inner and outer cylinders.

5. Apparatus for absorbing a jerking load applied to the end of a cable used to displace a wheeled vehicle along a horizontal track in a first direction, said vehicle having a horizontal roll affixed thereto around which is wrapped less than 360° of a web of material which material tends to move said vehicle in a direction opposite to said first direction, comprising:

a. a vertical spindle attached at one end thereof to said vehicle; ;p1 b. a vertical drum around which said cable may be wrapped, said drum being disposed around said spindle so as to be coaxial with said spindle and rotatable about the axis of said spindle;

c. a horizontal arm affixed at a first end to said drum, said arm extending radially from said drum and perpendicular to the axis of said drum, said arm having a vertical face area on the other end of said arm perpendicular to the direction of movement of said arm when said drum is rotated about said spindle, said face area being disposed on the leading side of said arm when said arm is moved by the action of said load on said cable and said cable on said drum respectively, said arm also having a means for retaining the end of said cable;

d. a bracket means affixed to said vehicle and having a vertical surface disposed parallel to and opposite to said face area;

e. a first resilient member disposed between said face area and said surface, said resilient member being affixed to either said face area or said surface or both said face area and to said surface;

f. a second resilient member coaxial with said first resilient member, said second resilient member being affixed to the opposite side of said surface from said first resilient member; and g. a cover plate affixed to the end of said drum furthest from said vehicle and configured so as to retain said drum on said spindle.

6. Apparatus of claim 5 in which said drum comprises:

a. an inner cylinder having a bearing surface in closely spaced clearance relation to said spindle;

b. an outer cylinder coaxial and coextensive with and of greater diameter of said inner cylinder, said outer cylinder being configured so as to allow said cable to be wrapped therearound; and, c. plate means to join the ends of said inner and outer cylinders.

* * * * *